US009802783B1

(12) United States Patent
Crow

(10) Patent No.: US 9,802,783 B1
(45) Date of Patent: Oct. 31, 2017

(54) YARN CONE HOLDER WITH YARN RETENTION ARM

(71) Applicant: Mitchell A. Crow, Dalton, GA (US)

(72) Inventor: Mitchell A. Crow, Dalton, GA (US)

( * ) Notice: Subject to any disclaimer, the term of this patent is extended or adjusted under 35 U.S.C. 154(b) by 84 days.

(21) Appl. No.: 14/812,418

(22) Filed: Jul. 29, 2015

Related U.S. Application Data

(60) Provisional application No. 62/045,263, filed on Sep. 3, 2014.

(51) Int. Cl.
*B65H 49/06* (2006.01)
*B65H 49/16* (2006.01)
*D02H 1/00* (2006.01)

(52) U.S. Cl.
CPC ..... *B65H 49/06* (2013.01); *B65H 49/16* (2013.01); *D02H 1/00* (2013.01)

(58) Field of Classification Search
CPC ..... B65H 49/06; B65H 49/14; B65H 49/16; D02H 1/00
USPC ..... 242/130.1
See application file for complete search history.

(56) References Cited

U.S. PATENT DOCUMENTS 2,546,301 A * 3/1951 Garden ..... B65H 49/06 242/130.1
2,574,285 A * 11/1951 Rea ..... B65H 49/06 242/129.7
2,704,643 A * 3/1955 Lambach ..... B65H 49/06 242/130.1
4,824,042 A * 4/1989 Whitaker ..... B65H 49/06 242/130

* cited by examiner

*Primary Examiner* — William E Dondero
(74) *Attorney, Agent, or Firm* — Walter A. Rodgers

(57) ABSTRACT

A yarn cone holder whereby the yarn cone is mounted on an angled wire section of the holder with a yarn retention arm disposed substantially below the yarn cone and extending outwardly therefrom and including a resilient pad with the lower edge of the yarn cone deforming the resilient pad.

12 Claims, 4 Drawing Sheets

YARN CONE HOLDER WITH YARN RETENTION ARM

The benefits under 35 U.S.C. 119 are claimed of provisional patent application 62/045,263 filed Sep. 3, 2014.

BACKGROUND OF THE INVENTION

Creels are widely used in the textile and the carpet industry on which multiple yarn cones are mounted at varying positions on the creel. Yarn is unwound from the cone and transferred to tufting, warping, weaving looms and other like-type machines. During this process, yarn is unraveled from the cardboard yarn cone at high speed which causes inherent vibration in the cone itself. This results in the strands of yarn wrapped around the cone and disposed closest to the creel post tending to slide away from the cone which can cause interference in the operation of the creel including yarn breakage and yarn tightening which requires the operator to manually reposition the yarn strands on the cone. By this invention, lower strands of yarn are maintained in position and the need for yarn end and tension detectors is eliminated.

BRIEF SUMMARY OF THE INVENTION

In textile manufacturing, multiple yarn cones are mounted on a creel by means of a yarn cone holder. As the yarn is removed from the cones, yarn wound on the lower portions of the cones tends to unravel. In order to prevent undesirable unraveling, according to this invention, a wire cone holder includes angular wire cone engaging means with the yarn cone mounted thereon and which is attached to the creel by means of an attachment bracket. A yarn retention arm including a base plate with a foam pad mounted thereon extends laterally from the cone engaging means so that the lower edge of the yarn cone depresses the resilient foam causing the foam pad to envelop the lower strands of yarn mounted on the cone and thereby maintain them in their proper position. This results in the elimination of the need for tight end detectors and motion sensors so that the machine operates at a higher production efficiency.

Over time, yarn cones tend to collapse and assume an irregular shape making it difficult to install them on a conventional wire cone holder. According to this invention, the wire cone engaging means includes a pair of angular spaced wire sections extending from an attachment bracket with the distal looped ends angled inwardly to facilitate mounting of the yarn cone even if it is substantially collapsed.

DETAILED DESCRIPTION OF THE INVENTION

Figure 1:
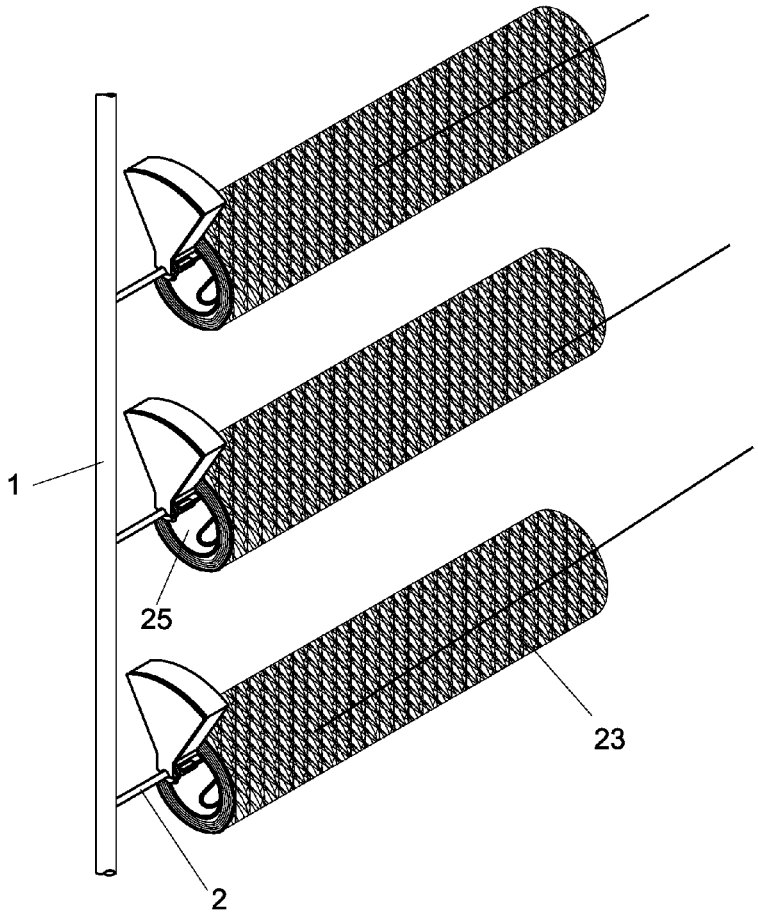
FIG. 1 is a partial representation of multiple yarn cone holders mounted on a creel.
Figure 2:
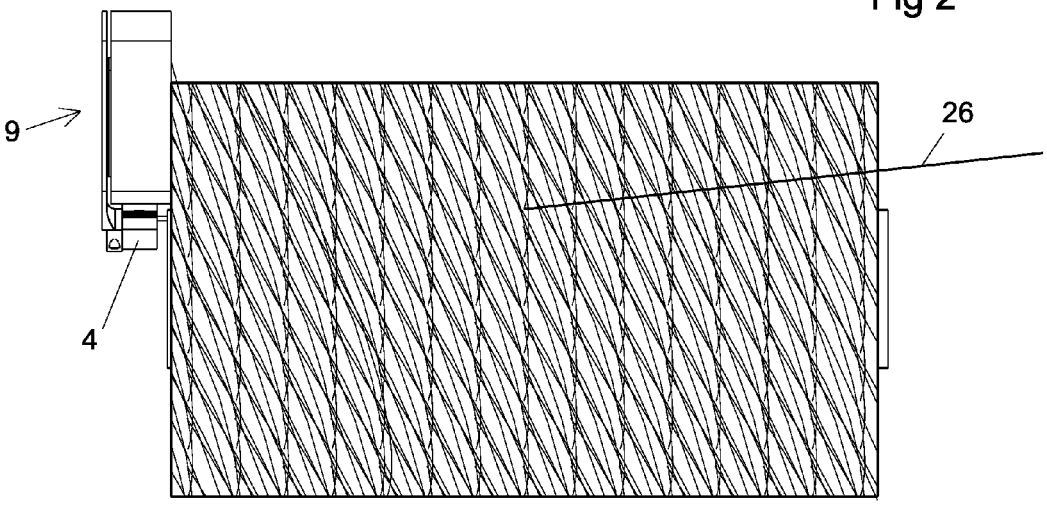
FIG. 2 is an enlarged side elevational view of a yarn cone holder with a yarn cone mounted thereon, according to this invention.

In the drawings and with particular reference to FIG. 1, numeral 1 designates an upright frame member or creel post of a conventional creel with multiple vertically arranged support shafts 2 extending outwardly and generally laterally therefrom.

Figure 3:
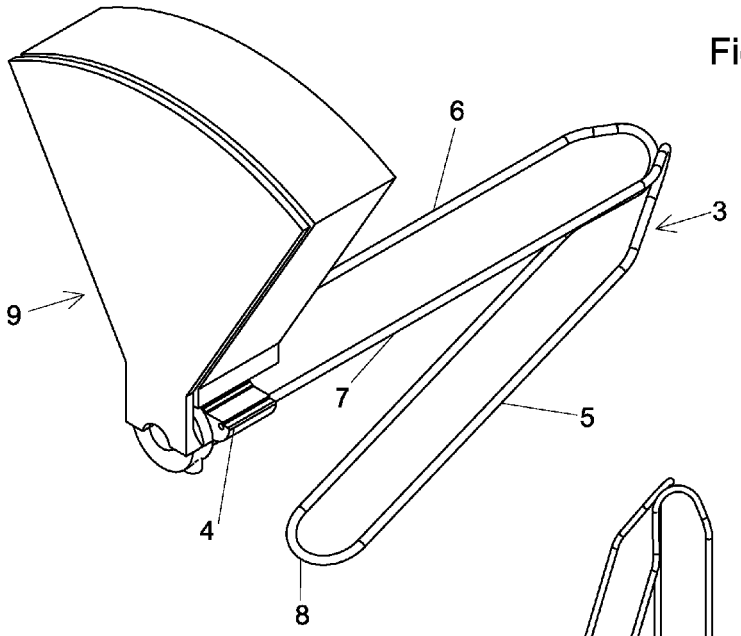
FIG. 3 is a perspective view of the yarn cone holder and retention arm.
Figure 4:
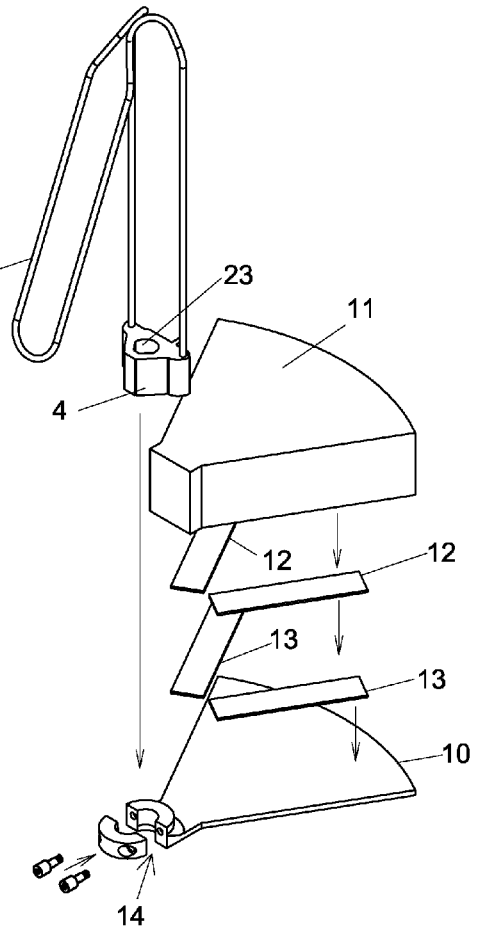
FIG. 4 is an exploded perspective view of the holder shown in FIG. 3.

As shown in FIG. 3, the yarn cone holder is designated generally by the numeral 3 and includes attachment bracket 4 and wire cone engaging means 5. Wire cone engaging means 5 includes wire sections 6 and 7 the free ends of which are secured to bracket 4, as is well known. Wire sections 6 and 7 extend in a generally parallel fashion from bracket 4 outwardly and loop around through an angle substantially greater than 90 degrees whereby the ends opposite from bracket 4 are integrally joined together by connector 8. The distal looped ends of wire sections 6 and 7 are angled inwardly so that the tips are in close proximity to the point of touching or slightly separated.

According to a feature of this invention and as best shown in FIGS. 4-7, the yarn retention arm is indicated generally by the numeral 9 and includes base plate 10 and foam pad 11. Foam pad 11 is manufactured of any suitable resilient foam material and is secured to base plate 10 by means of conventional hook strips 12 and loop strips 13 adhered, respectively, to foam pad 11 and base plate 10. By this means, foam pads 11 are quickly removed and replaced, as needed, due to wear and tear. Foam pads 11 are also attachable to base plate 10 by more permanent means such as glue and the like.

Figure 5:
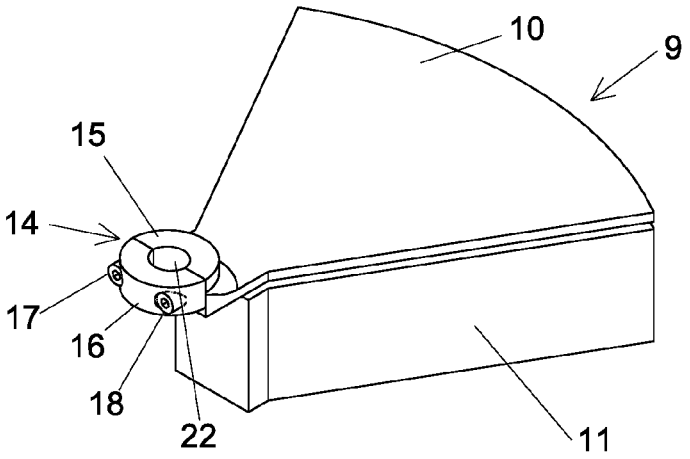
FIG. 5 is an inverted perspective view of a modified retention arm.

In order to attach yarn retention arm 9 to creel support shaft 2, various types of brackets are utilized. One such bracket is shown in FIG. 5 in the form of a split collar bracket generally designated by the numeral 14 by which semicircular clamp 15 is secured by welding and the like to base plate 10. In order to attach retention arm 9 to support shaft 2, without the necessity of removing and replacing wire cone engaging means 5, semicircular clamp 15 is positioned around support shaft 2 and corresponding semicircular clamp 16 is placed on the opposite side of support shaft 2. Then semicircular clamps 15 and 16 are secured together by means of screws 17 and 18 so that yarn retention arm 9 is securely fastened to support shaft 2 and extends through aperture 22. By separating semicircular clamps 15 and 16, retention arm 9 is easily removed and replaced without the necessity to disassemble and remove any other elements of yarn cone holder 3.

Figure 6:
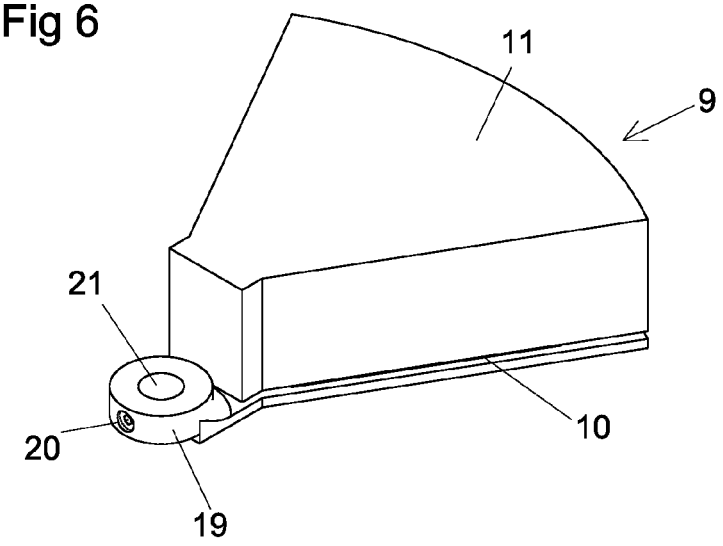
FIG. 6 is a perspective view of a further embodiment of the retention arm.

An alternate yarn retention arm attachment means is shown in FIG. 6 by which circular bracket 19 is attached to base plate 10 by welding and the like and is provided with set screw 20. In order to install yarn retention arm 9 on the creel, it is positioned so that support shaft 2 extends through aperture 21 of circular bracket 19. Bracket 19 is then secured in place by set screw 20 and retention arm 9 is in an operational position as shown generally in FIG. 1.

Figure 7:
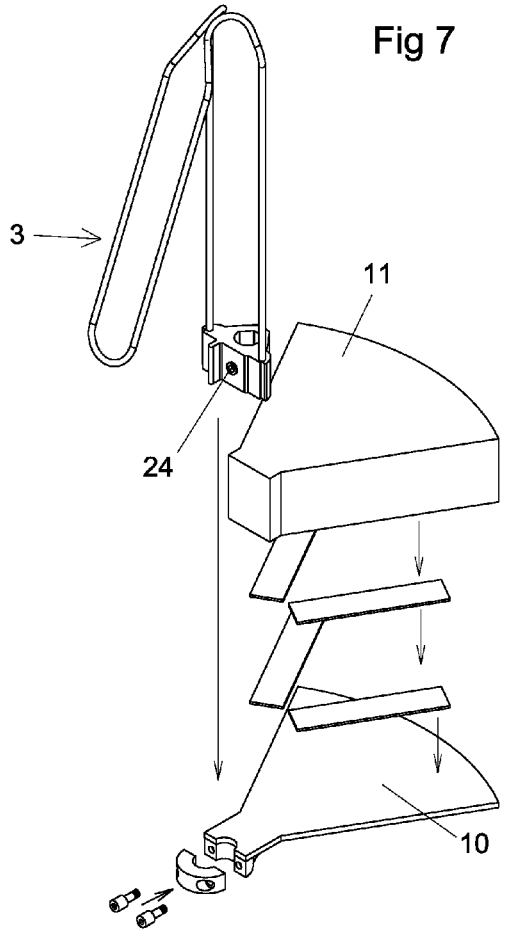
FIG. 7 is an exploded view of a modification of the wire yarn holder and retention arm shown in FIG. 4.

Following this, yarn cone holder 3 is positioned on support shaft 2 whereby support shaft 2 extends through aperture 23 of attachment bracket 4 such that the lower surface of attachment bracket 4 is in face contacting relation with the upper surface of either circular bracket 19 or split collar bracket 14 depending on which type of bracket is being used. Attachment bracket 4 is secured to support shaft 2 by means of set screw 24 extending through an aperture formed in attachment bracket 4, as shown in FIG. 7.

Yarn cone 25 is then positioned on yarn cone holder 3 in known manner. Since the inner diameter of yarn cone 25 is less than the angular disposition of wire cone engaging means 5, the resulting outwardly biasing force on the inside of yarn cone 25 acts to maintain the yarn cone in its proper operational position on the creel, as shown in FIG. 1.

Since the lower strands of yarn 26 tend to unravel in practice, it is necessary to maintain yarn 26 from unraveling around the inner edge of yarn cone 25 which causes a tight end or break out. This is accomplished by the resiliency of foam pad 11 whereby the inner edge of yarn cone 25 closest to the creel post 1 is caused to depress foam pad 11 inwardly an amount sufficient to cause the surrounding foam to envelope and thereby hold the lower strands of yarn 26 in position.

Depending on the access limitations of the particular creel, bracket 4 is positioned so that set screw 24 is accessed from above or below and affixed to support shaft 2 by means of set screw 24.

Figure 8:
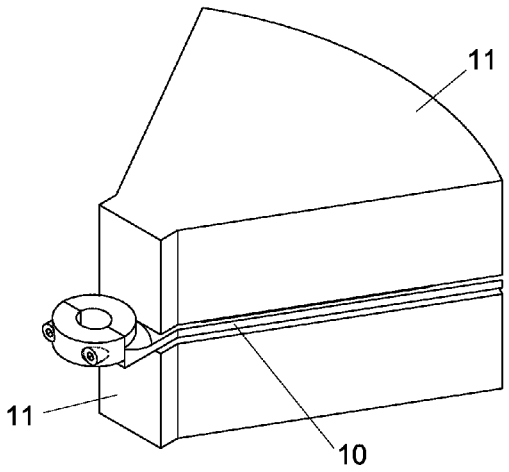
FIG. 8 is a perspective view of further embodiment of the retention arm.

In some applications of this invention, it is desirable to affix a second foam pad 11 to the opposite side of base plate 11, as shown in FIG. 8, so that, in effect, base plate 10 is fully enveloped in foam so as to prevent any operator injuries resulting from inadvertent contact with exposed metal parts of base plate 10.

The feature of applicant's invention of the looped distal ends of wire sections 6 and 7 being angled inwardly and touching facilitates the placement of yarn cones 25 onto wire cone engaging means because typically the cardboard yarn cones themselves tend to collapse over time which are clearly difficult to place onto conventional yarn cone holders in which the distal ends are not substantially turned inwardly.

The invention claimed is:

1. A yarn holder comprising an attachment bracket, wire cone engaging means secured to said attachment bracket to receive a yarn cone, said wire cone engaging means comprising elongated parallel wire sections extending from said bracket with the distal ends remote from said bracket rotated through an angle greater than 90 degrees and being interconnected, a yarn retention arm positioned in proximity to said bracket and extending laterally from said bracket, said yarn retention arm comprising a base plate and a resilient pad overlying said base plate, said yarn cone comprising an inner edge adjacent said attachment bracket, and said inner edge being depressed into said resilient pad.

2. The yarn holder according to claim 1 wherein said resilient pad is secured to said base plate by a hook and loop attachment.

3. The yarn holder according to claim 1 wherein an aperture extends through said attachment bracket, said yarn holder is attachable to a creel, said creel comprises a support shaft, and said support shaft extends through said aperture of said attachment bracket.

4. The yarn holder according to claim 1 wherein said base plate is attached to a creel and said creel comprises a support shaft.

5. The yarn holder according to claim 4 wherein said base plate is attached to said support shaft by a circular bracket.

6. The yarn holder according to claim 4 wherein said base plate is attached to said support shaft by a split collar bracket comprising a pair of semicircular clamps.

7. The yarn holder according to claim 1 wherein said parallel wire sections comprise respectively outer looped ends and said outer looped ends are angled inwardly in close proximity to each other.

8. The yarn holder according to claim 7 wherein said outer ends are in abutting relation to each other.

9. The yarn holder according to claim 1 wherein a second resilient pad is positioned on the opposite side of said base plate.

10. The yarn holder according to claim 9 wherein said second resilient pad is of the same configuration as said resilient pad.

11. A yarn holder comprising an attachment bracket, wire cone engaging means secured to said attachment bracket, said wire cone engaging means comprising elongated parallel wire sections extending from said bracket with the distal ends remote from said bracket rotated through an angle greater than 90 degrees and being interconnected, said elongated wire sections respectively comprising outer looped tips, and the outer looped tips of said elongated wire sections being angled inwardly beyond the parallel wire sections and disposed in close proximity to each other.

12. The yarn holder according to claim 11 wherein said outer looped tips are angled inwardly in abutting relation to each other.

* * * * *